US005351347A

United States Patent [19]

Kunkel

[11] Patent Number: 5,351,347

[45] Date of Patent: Oct. 4, 1994

[54] PROXIMITY CONTROLLED SANITARY FITTING

[75] Inventor: Horst Kunkel, Stuttgart, Fed. Rep. of Germany

[73] Assignee: Hansa Metallwerke AG, Stuttgart, Fed. Rep. of Germany

[21] Appl. No.: 842,489

[22] Filed: Feb. 27, 1992

[30] Foreign Application Priority Data

Mar. 1, 1991 [DE] Fed. Rep. of Germany ..... 4106540

[51] Int. Cl.[5] ..... E03C 1/05

[52] U.S. Cl. ..... 4/623; 137/607

[58] Field of Search ..... 4/623, 619; 137/392, 137/606, 607; 251/129.03; 361/176, 177, 179

[56] References Cited

U.S. PATENT DOCUMENTS

| | | | |
|---|---|---|---|
| 4,735,357 | 4/1988 | Gregory et al. | 4/623 |
| 4,741,363 | 5/1988 | Hu | 137/607 |
| 4,928,732 | 5/1990 | Hu | 137/607 |
| 5,156,187 | 10/1992 | Schmidt et al. | 137/607 |
| 5,167,255 | 12/1992 | Göhring et al. | 137/607 |

FOREIGN PATENT DOCUMENTS

| | | |
|---|---|---|
| 7873050 | 12/1978 | Fed. Rep. of Germany . |
| 3025603 | 7/1980 | Fed. Rep. of Germany . |
| 8310348.1 | 4/1983 | Fed. Rep. of Germany . |
| 8902238.6 | 2/1989 | Fed. Rep. of Germany . |
| 2335767 | 7/1977 | France . |

OTHER PUBLICATIONS

Journal "Sanitar- und Heizungnstechnik", 1989—A18.

*Primary Examiner*—William A. Cuchlinski, Jr.
*Assistant Examiner*—W. Morris Worth
*Attorney, Agent, or Firm*—Fred Philpitt

[57] ABSTRACT

A proximity controlled sanitary fitting is provided with a manually operated electric selector switch (6) which is formed the same way as a handle of a conventional manually operated sanitary fitting. The selector switch (6) can be see in various operating positions associated to different operating modes of the sanitary fitting. Among these operating modes there are in particular the following ones: normal detection of a user; deactivation of the non-tactile detection; and opening the fitting regardless of the electronic detection. Thus the electric selector switch can be optically integrated into the design of the sanitary fleeing in a way readily accepted by the public.

5 Claims, 3 Drawing Sheets

PROXIMITY CONTROLLED SANITARY FITTING

Figure 1:
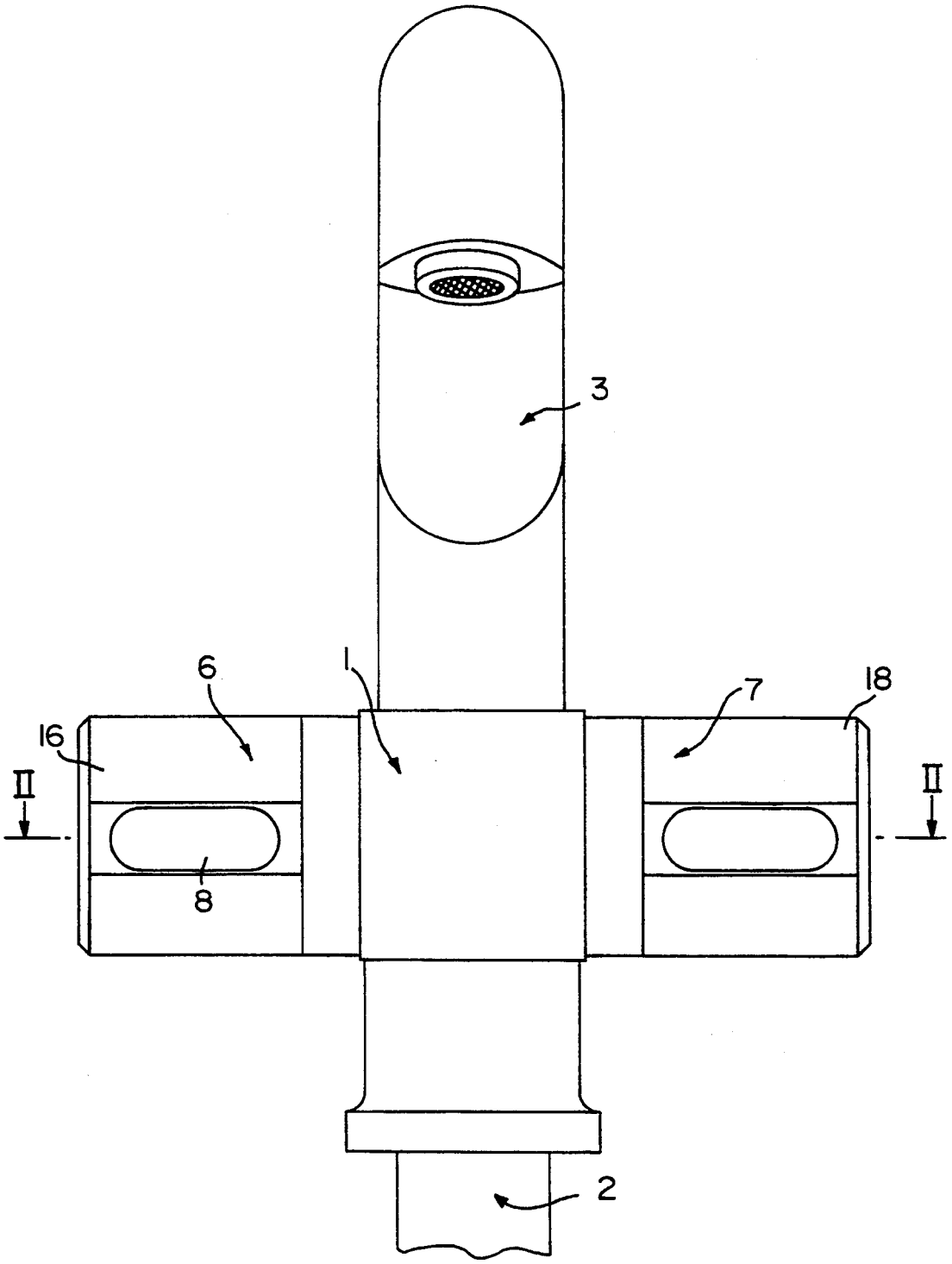

The invention relates to a proximity controlled sanitary fitting comprising a) a body b) essentially electronic components, particularly a sensor and an electronic circuit, which in one operating mode respond to the presence of a user in a detecting area in non-tactile manner and produce an output signal for the duration of such presence;

c) essentially mechanical components, particularly an electrically controlled valve, which controls flow of water in accordance with the output signal of the electronic components and eventually other determining factors.

Known such proximity controlled sanitary fittings can operate only in a single operating mode, i.e. "normal" detection of a user standing in front of the fitting, e.g. at a wash basin. Mechanical emergency functions may be provided to cope with situations, when the electronics fail.

The object of the present invention is to provide a proximity controlled sanitary fitting of the kind referred to above allowing operation in different operating modes simultaneously warranting a pleasant and attractive appearance.

In accordance with the present invention this object is solved by the fact that d) a manually operated electrical switch is provided which is formed like the handle of a conventional manually operated sanitary fitting and which can be positioned in a predetermined number of preselectable positions, wherein the electronic components work in one of a plurality of different operating modes, respectively.

Thus a sanitary fitting in accordance with the present invention presents itself to the user in the same manner as manually operated sanitary fittings, i.e. comprising a handle. However, in the fitting in accordance with the present invention the handle does not any longer have the function of adjusting the quantity and/or temperature of the discharged water. Contrarily, the handle is used as a "mode selector", i.e. an electric switch, which in accordance with it's different operating positions modifies the internal function of the electronics. In contrast to the handle of a conventional sanitary fitting, the electric switch provided by the invention and formed like a handle is operated only occasionally, when the user desires to change from one operating mode to another one. Since the visual appearance of a sanitary fitting in accordance with the present invention is very close to the appearance of a conventional manually operated sanitary fitting, as has been pointed out, such manner of integrating a mode selector switch into a sanitary fitting is readily accepted by the public. Furthermore, there are no difficulties in arranging such sanitary fittings among optically correspondingly designed sanitary fittings of the conventional type in one and the same room.

An embodiment of the invention, wherein the user operated member of the selector switch is formed like a turning handle off a manually operated sanitary fitting having an essentially horizontal axis of rotation, will be the most frequently used embodiment. It corresponds to the most common type of handles in conventional sanitary fittings used for adjusting the flow of water by a turning movement.

The most pleasant appearance of a sanitary fitting in accordance with the present invention is obtained, if the actuating member of the mode selector switch is formed as one of two handles being symmetrically arranged on the body such that the appearance of the fitting corresponds to the appearance off a conventional two handle fitting. It is preferred that for the purpose of the present invention than handle of the conventional sanitary fitting is used, which serves for flow control, since opening and closing of the fitting in accordance with the present invention normally is effected by the servo valve controlled by the electronic components.

In accordance with a further aspect of the invention the essentially electronic components are combined into one unit which is arranged in the grip handle shaped housing of the selector switch. Thus there is a further benefit, since the space defined by the handle shaped housing of the mode selector switch is simultaneously used for receiving the electronic components so that these components need not be accomodated in the body proper of the fitting. This allows for a slender and appealing design of the fitting. Furthermore the connection lines between the selector switch and the electronic components are short and since the latter are arranged for common rotation with the selector switch, there are only small mechanical loads for the electric connecting lines.

Since in accordance with the invention the electric components, particularly the sensor, are accomodated in a handle shaped housing of a selector mode switch, a particularly advantageous embodiment of the invention becomes possible, wherein a) the selector switch comprises one angular position, wherein the detection cone is oriented in downwardly sloped direction and wherein in this angular position b) the electrically operated servo valve is controlled into its open position, when no output signal of the essentially electronic components is obtained;

c) the electronic components respond to the surface level of a water volume located below the sensor and provide an output signal for closing the electrically controlled valve, when the level of the water surface reaches a predetermined value.

If in this embodiment the selector switch is rotated with respect to its horizontal axis of rotation into that one of the operating positions, wherein the detection cone of the sensor extends in downwardly sloped direction, two effects are obtained simultaneously: by electronic control, i.e. responsive to the new operating position of the selector switch, flow of water is initiated without any need of establishing such flow on the basis of a sensor signal. The electronic components are now programmed in a different way such that they do not provide an output signal initiating flow of water but provide an output signal interrupting flow of water. The latter signal is obtained, when the level of the volume of water contained in the wash basin or the like has reached a predeterminated value. This fact can be monitored by the sensor, because the sensor has been brought into a position being different from its normal position by turning the handle shaped housing of the selector switch.

As has been pointed out above, the invention aims at a visual appearance of a proximity controlled sanitary fitting corresponding to the appearance of a conventional two handle sanitary fitting, wherein the mode selector function is integrated into a first handle, while the second handle is associated to the essentially mechanical components forming another unit. Thus again the space available in a handle member is advantageously made use of. Combining the essentially mechanical components of the fitting and the second handle into one unit is also advantageous in view of maintenance of the mechanical components, since they can be easily detached from the fitting together with the second handle.

For many applications an embodiment of the invention is advantageous, wherein the mode selector switch comprises two operating positions corresponding to the below operating modes:

a) normal non-tactile detection of a user in accordance with feature a) of the main claim;
b) deactivation of the non-tactile detection, when electrically controlled valve is closed;
c) opening of the electrically controlled valve without occurrence of an output signal of the essentially electronic components.

If the electronic components and particularly the proximity sensor are integrated into the mode selector switch and if the latter is in the position, wherein the switch establishes the normal operating mode (non-tactile detection of a user), the components and the sensor are oriented such that the detection cone of the sensor is oriented in horizontal forward direction. In the second operating position of the selector switch undesired triggering of the sanitary fitting is eliminated, as is desired for cleaning purposes or the like. In the third operating position of the selector switch continuous discharge of water is allowed for without any need for any presence of a hand of a user or another object in the detection cone of the sensor. Thus a wash basin may be filled with water.

In a further variant of this embodiment a timer is provided which will close the electrically controlled valve after a predetermined time of opening. The timer is adjusted to the flow capacity of the sanitary valve such that overflow of the wash basin or another water receiving receptacle arranged below the fitting is avoided.

Figure 2:
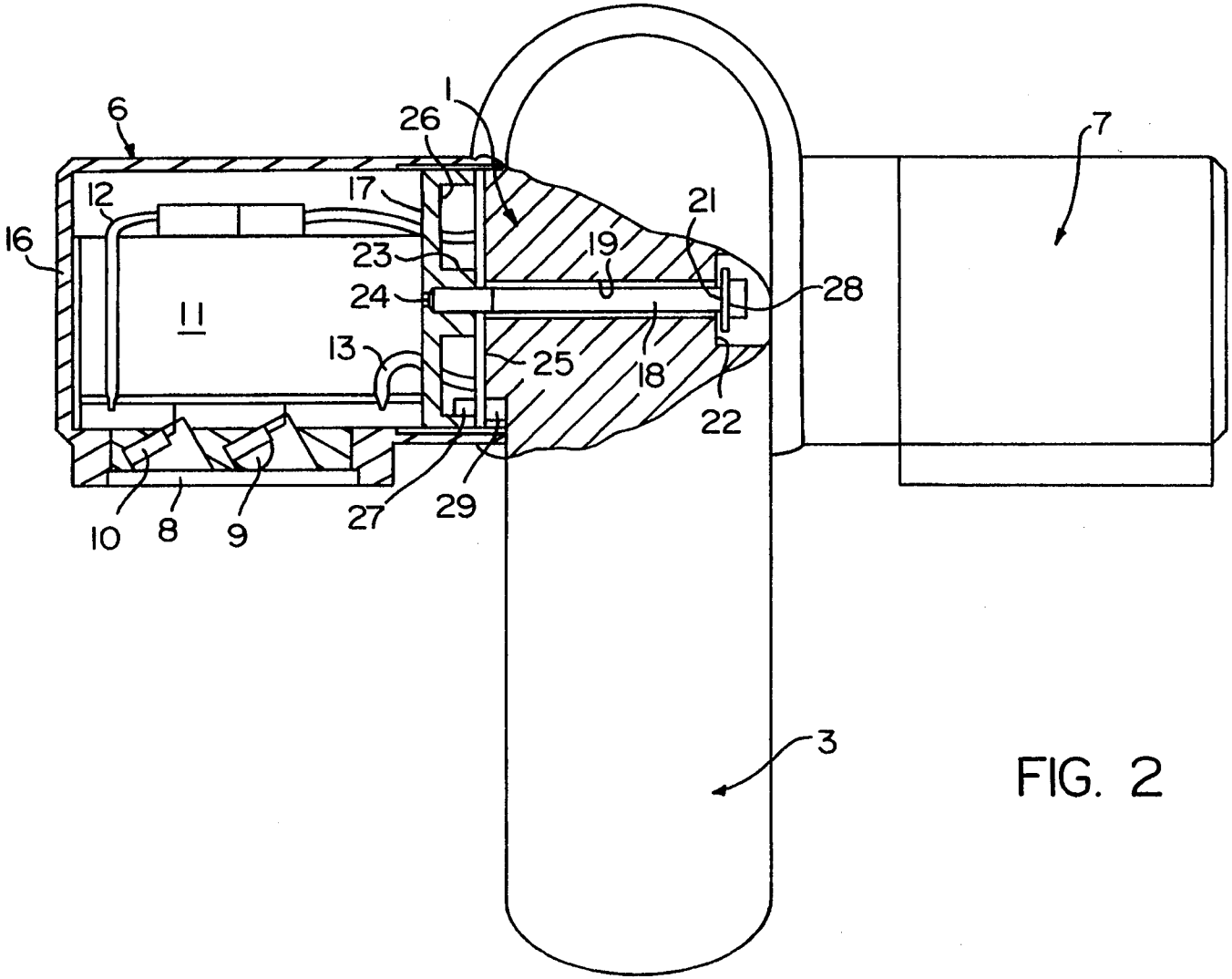
Figure 3:
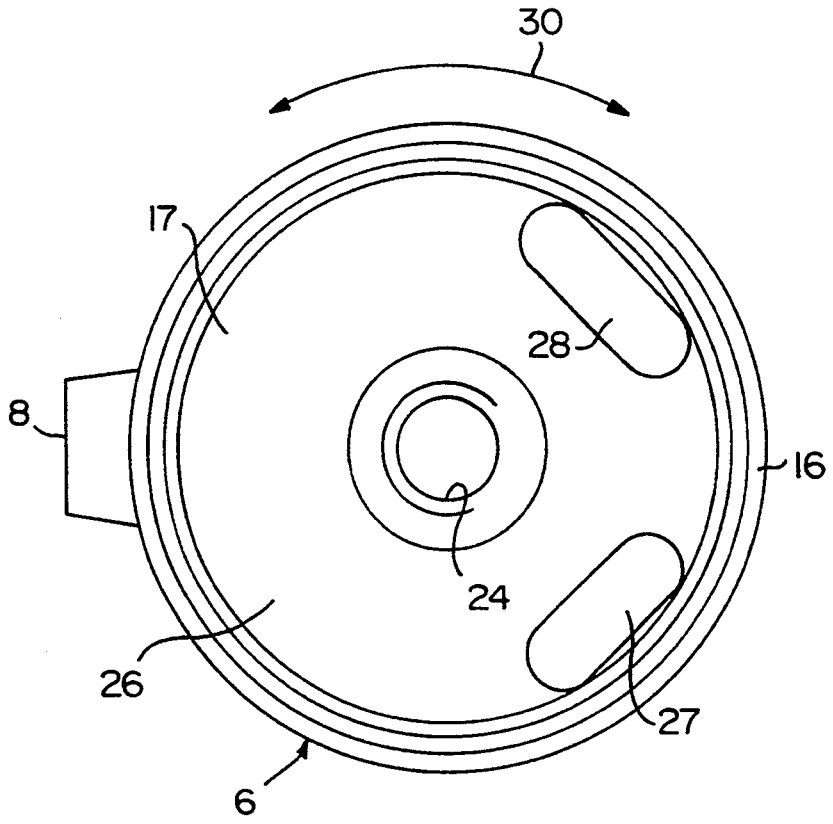

A preferred embodiment of the invention will now be described in more detail referring to the drawings. Therein FIG. 1: is a front view of a proximity controlled sanitary fitting;

FIG. 2: is a top view of the sanitary fitting of FIG. 1, a left hand portion thereof being axially cut along line II—II of FIG. 1; and FIG. 3: is a bottom view of a mode selector handle of the sanitary fitting of FIG. 1.

As may be seen from FIG. 1 of the drawings, five main components of the proximity controlled sanitary fitting shown may be discerned:

A central main body 1, the lower end of which carries a base member 2 and the upper end of which carries a pivotable spout 3. Supply passageways for hot and cold water, which are not shown in the drawings, extend through the base member 2.

The main body 1 carries two handles 6 and 7 being arranged symmetric with respect to the vertical center plane of the fitting.

The left hand handle 6 has two functions: it serves for receiving the electronic components of the proximity controlled sanitary fitting. An optical exit and entrance window 8 being transparent to the infrared light used for detection of a user is shown in FIGS. 1 and 2. The window 8 is made from dark tinted glass so that its function of an optical window is disguised and a transmitter diode 9 as well as a receiver diode 10 cannot be seen by the user. As has been shown in FIG. 2, an electronic unit 11 is arranged in the interior of the handle 6. A cable 12 is provided for the voltage supply of the electronic unit 11, which furthermore is connected to an electrovalve by a further cable 13 to thus control the flow of water. The cable 12 extends through an axial bore of the main body 1 and the base member 2 being parallel to the main water conducting bore of the fitting and is connected to a suitable voltage supply.

The arrangement has been chosen such than all those components of the fitting are combined into one unit, which is accomodated in the handle 6, which are "electronic components" in the sense that they serve for the non-tactile electronic detection of a user in front of the sanitary fitting and for production of control signals, which can be used for controlling an electrovalve.

The second function of the handle 6 is the function of a turning switch serving to establish one of a plurality of operating modes of the sanitary fitting. To this end the handle 6 can be rotated or pivoted with respect to horizontal axis between three operating positions, which will be described in more detail below.

The handle 6 comprises a cup shaped housing 16, the open end of which faces the main body 1. A bottom member 17 is threaded into this open end of the cup shaped housing 16. A shaft 18 extends through a bore 19 of the main body 1. The right hand end of the shaft 18 is formed with a screw head 20, which via a washer 21 engages a shoulder 22 of the bore 19, as shown in FIG. 2. Thus the shaft 18 can be rotated with respect to the main body 1 in fixed axial position.

A left hand end portion of the shaft 18 projecting from the main body 1 is formed with threadings 23 cooperating with a threaded central bore 24 of the bottom member 17. Thus by means of the shaft 18 the handle 6 is rotatably journalled on the main body 1. Additional guiding of the handle 6 on the main body 1 is obtained by the fact that the right hand, inward end portion of the cup shaped housing 16 engages into corresponding grooves formed in an essentially flat left hand end face 25 of the main body 1, as shown in FIG. 2. By providing appropriate washers between the handle 6 and the main body 1, the frictional resistance opposing rotation of the handle can be adjusted.

The bottom member 17 sealing the cup shaped housing 16 of the handle 6 is formed with an annular space 26 cut into its end face being adjacent to the main body 1. Two reed contacts 27, 28 are arranged in the annular space 26, as may also be seen from FIG. 3. The reed contacts 27, 28 are electrically connected to the electronic unit 11 and determine operation thereof in a manner described in more detail below.

The reed contacts 27, 28 cooperate with a permanent magnet 29 arranged in a recess formed in the left hand end face 25 of the main body 1, as shown in FIG. 2. The handle 6 and the main body 1 are formed with suitable means, which together form appropriate detents and abutments, which facilitate selective positioning of the handle 6 by rotation thereof with respect to the axis of shaft 18. The three operating positions of the handle 6 are characterized as follows:

In a first or normal position shown in FIG. 1 the normal of the optical window 8 is oriented in essentially horizontal forward direction. Such orientation is normal in non-tactile detection of a user in front of a sanitary fitting. In this angular position of the handle 6 the magnet 29 is located hale way the angular distance of the two reed contacts 27, 28 and will not influence the latter. If the reed contact 27, 28 are not actuated, the electronic unit 11 is set into its normal operating mode in accordance with the position of handle 6.

Starting from the normal position just described above the handle 6 can be rotated in either sense of rotation as has been indicated by a double arrow 30 in FIG. 3. If the handle 6 is rotated in clockwise direction, the normal of the window 8 is oriented in upwardly sloped direction. By such rotary movement the reed contact 28 will be angularly aligned with and face the magnet 29 arranged in the recess of end face 25 of the main body. Thus the reed contact 28 will deactivate the electronic unit 11 arranged in the handle 6. Thus in the second angular operating position off the handle 6 just described there is no non-tactile detection of a user. This second operating position can be selected for cleaning the sanitary fitting or the wash basin, to which the fitting is affixed, or for other purposes.

A third operating position of the handle 6 is obtained, if the handle is rotated from its normal operating position in the counter-clockwise direction of double arrow 30 of FIG. 3.

Now the reed contacts 27 are angularly aligned with the magnet 29 and are actuated thereby. The output signal of the reed contacts 27 establish an operating mode of the electronic unit, wherein water is continuously discharged from the spout 3 regardless of the presence or nonpresence of a user in front of the window 8. Thus the sanitary fitting can be manually opened by turning the handle 6 from the central normal position into the just described third position.

The flow of water discharged from the sanitary fitting can always be terminated by returning the handle 6 into its central (normal) or into its upper operating position. Furthermore an additional operating position may be provided, wherein the flow of water discharged from the pivotable spout 3 is automatically terminated after lapse of a predetermined period of time being sufficient for discharging a predetermined volume of water into the wash basin.

The particular embodiment of a sanitary fitting, shown in the drawings will automatically terminate the flow of water, when the level of the water volume, that has accumulated in the wash basin, will have reached a predeterminated value. To this end use is made of the transmitter diode 9 and the receiver diode 10, which normally are used for detecting a user. By turning the handle 6 into its third operating position, the normal of the window 8 faces in downwardly sloped direction and thus the radiation emitted from the transmitter diode 9 is also oriented in downwardly sloped direction thus being able to cooperate with the rising level of the water volume, which thus can be automatically monitored. If the water level reaches a predetermined value, which can be selected by adjustment of the electronic unit 11, the light reflected from the surface of the water volume and impinging onto the receiver diode 10 will have such an intensity that the electronic unit 11 will stop discharge of water from the spout 3. So unintentional overflow of water from the wash basin is avoided in the third or "continuous flow" operating position of the handle 6, too.

For completeness' sake it should be noted that the right hand handle 7 of the sanitary fitting shown in FIGS. 1 and 2 receives a unit comprising all those components which are used for controlling the flow of water and which for this reason can be considered as "mechanical" components. These mechanical components particularly include an electrically controlled valve and-if desired-a mixing valve for adjusting the temperature of the water discharged.

I claim:

1. A sanitary fitting for the controlled dispensing of water which comprises in combination:

(a) a main body including a spout through which a supply of water is adapted to flow, (b) an electrically controlled valve closely associated with said main body for controlling the flow of water through said spout, an electronic proximity detector comprising a radiation emitting transmitter, and a receiver for said radiation, and an electronic unit associated with said fitting for sensing at least one of a user and a water level and producing an output control signals electrical connection means being provided for connecting the output control signal to said valve, (c) a handle adjustably mounted to said main body, (d) switching means operatively activated by said handle for controlling operation of said electronic proximity detector, (e) said handle extending outwardly from said main body and separate from said spout, said handle being manually adjustable to positions that include:

(1) a first position in which said electronic proximity detector is active and sensitive to the presence of a user and provides said output control signal to said valve which controls the flow of water through said spout, (2) a second position in which said electronic proximity detector is not active and in this position said valve is closed to prevent the flow of water through said spout, and (3) a third position in which said electronic proximity detector is active but not sensitive to the presence of a user and in this position said valve is open to permit the flow of water through said spout.

2. A sanitary fitting according to claim 1 wherein said handle has an essentially horizontal axis of rotation.

3. A sanitary fitting according to claim 1 wherein said handle comprises one of two handles that are symmetrically arranged on said main body so that the appearance of the fitting resembles the appearance of a conventional two handle fitting.

4. A sanitary fitting in accordance with claim 1, wherein in said third position of said handle the electronic proximity detector generates a detection zone which extends in a downwardly sloped direction and in this third position said valve is opened and is only closed in response to said output control signal from the electronic proximity detector when said detector senses that the water surface below it has reached a predetermined level.

5. A sanitary fitting in accordance with claim 3 wherein said electrically controlled valve is operatively housed within the second of said two handles.

* * * * *